US006306259B1

(12) United States Patent
Lamas et al.

(10) Patent No.: US 6,306,259 B1
(45) Date of Patent: Oct. 23, 2001

(54) DEVICE FOR THE TREATMENT OF A FIBROUS SUSPENSION

(75) Inventors: Axel Lamas; Stefan Hansson, both of Karlstad; Bo Clarstrom, Kil; Jesper Karrhammar, Gothenburg; Goran Brottgardh, Karlstad, all of (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/488,699

(22) Filed: Jan. 20, 2000

(30) Foreign Application Priority Data

Mar. 9, 1999 (SE) ..... 9900835

(51) Int. Cl.[7] ..... D21F 1/00

(52) U.S. Cl. ..... 162/301; 162/300; 162/323; 162/358.1; 100/118; 100/120; 210/401; 210/400

(58) Field of Search ..... 162/301, 300, 162/323, 358.1; 100/118, 120; 210/401, 400

(56) References Cited

U.S. PATENT DOCUMENTS

| | | | | |
|---|---|---|---|---|
| 3,980,518 | | 9/1976 | Ljung et al. . | |
| 4,543,161 | * | 9/1985 | Fujimoto | 162/323 |
| 5,868,903 | * | 2/1999 | Petschauer et al. | 162/301 |

FOREIGN PATENT DOCUMENTS 501 710 C2 5/1995 (SE) .

WO 9854401 A1 12/1998 (WO) .

* cited by examiner

*Primary Examiner*—Peter Chin
*Assistant Examiner*—M. Halpern
(74) *Attorney, Agent, or Firm*—Fasth Law Offices; Rolf Fasth

(57) ABSTRACT

Device for the washing and dewatering a fibrous suspension, which device incorporates two hollow, circular cylindrical filter drums (1), which filter drums incorporate evacuation chambers inside the-filter drums for evacuation of fluid. The filter drums rotate in opposite directions to create a pinch (2) where at least one of the said filter drums (1) is installed in a trough (7,8) which partly encloses the outer surface (3) of the filter drum and which, in the direction of rotation of the filter drum, converges towards the outer surface of the filter drum. At least one pulp inflow chamber (4) is installed at the highest point (1) of one or both of the filter drums each equipped with a trough for the introduction of pulp between the outer surfaces (3) of the filter drum and its trough (7,8) for the formation of a fibrous web. The trough (7,8) is designed to enclose the outer surface (3) of the filter drum, from the inflow chamber (4) and further round at least 230° of the circumference of the outer surface, so that the said fibrous web during operation is constrained to run between the filter drum's outer surface (3) and the trough (7,8) round at least 230° of the circumference of the outer surface before the fibrous web reaches the pinch (2).

22 Claims, 2 Drawing Sheets

DEVICE FOR THE TREATMENT OF A FIBROUS SUSPENSION

TECHNICAL FIELD

The present invention relates to a device for washing and dewatering a fibrous suspension.

BACKGROUND AND SUMMARY OF THE INVENTION

In the production of pulp from cellulose containing fibrous materials there are one or several points in the process where there is a need to wash and de-water the pulp.

A known and habitually used device for the washing and dewatering of pulp is disclosed in SE-C-380 300. The device shown therein utilizes two cylindrical, rotatable filter drums arranged in an essentially converging trough, which however is partly diverging at the inlet for the wash fluid. Characteristic of this existing type of device, as shown in SE-C-380 300, is that the trough normally extends round only about 180° of the filter drum's circumference, even if FIG. 1 in the description shows a gap for the pulp between the filter drum and the trough (not shown), which seem to extend somewhat further over the filter drum's circumference. This implies that effective dewatering of the pulp can only be achieved under a relatively limited sector of the filter drum's circumference, since effective dewatering only takes place where the pulp is pressed by the trough walls against the filter drum.

SE-C-501 710 seems to disclose a further development of the device in SE-C-380 300, and deals principally with the sealing aspect. The same applicant also has U.S. Pat. No. 5,488,900 and SE-C-504 011, in which the US patent discloses a device with pulp inflow arranged at the bottom, whereas the Swedish patent discloses a simplified arrangement, which is not designed to wash the pulp and which gives a relatively low dryness of the out flowing pulp, where it is also is said that a certain re-wetting of the dewatered pulp flow is inevitable.

Other examples of known devices are disclosed in U.S. Pat. Nos. 4,543,161 and 5,667,642 in which the latter shows a device where the drum rotates in the opposite direction to that conventionally used, i.e. seen from the end face the right drum rotates anticlockwise and the left clockwise.

For wash presses with only one filter drum it is known to arrange a trough which extends round a larger sector of the filter drum's circumference and which thereby provides a longer effective dewatering zone. See for example U.S. Pat. No. 4,986,881 where however cleaning means to flush away remaining fibre residues on the filter drum is missing. U.S. Pat. Nos. 4,085,003 and 5,046,338 also show embodiments with only one filter drum.

In SE-C-318 182 (CA,A,862450) a wash press is shown with one hollow filter drum (FIGS. 1 and 2) and also a variant with two hollow filter drums (FIG. 3) where in the latter case one filter drum is arranged above the other filter drum. Here information about means for continuous cleaning/flushing away of remaining fibre residues on the filter drum is missing. In the practical implementation of the designs with one filter drum (FIGS. 1 and 2) flushing nozzles have been installed immediately after the removal of the dewatered fibrous web.

The pulp inflow chamber (detail 3) has in that case been limited in the direction of rotation of the filter drum so that a space is found for these nozzles. Consequently, the water which is led down does not adversely affect the dewatering function as the water only splashes on the pulp inflow chamber containing pressed and not dewatered pulp. Normally, the process water is not sprayed on the pulp in the pulp inflow chamber where the pulp is put underpressure. The variant with two filter drums (FIG. 3) has not resulted in a commercial product, partly due to the fact that a good solution for continuous flushing of the remaining fibre residues has not been found for the upper filter drum. If the flushing liquid from the nozzles is to be prevented from wetting the dewatered pulp, an extensive deflection plate must be installed over the press roller and conveyer screw as well as over the whole width of the dewatering press, with the objective of collecting this flush water. In the embodiment shown the cutting plough share and inflow sealing are integrated in one and the same part.

In U.S. Pat. No. 5,421,176 a further alternative to the solution is disclosed, in which a cylindrical, hollow filter drum cooperates with a solid press roller (detail 32). Here the pulp web extends over about 300° and the flushing away of the fibre residues is achieved with a spray (detail 52) arranged alongside the filter drum's descending surface. These sprays are often found in a specific number distributed over the filter drum. Normally the flushing water is supplied to the sprays at a pressure level of about 2–8 bar.

A problem with devices according to the known technology, with two contra-rotating cylindrical filter drums, is that effective dewatering only takes place on a relatively limited section of the circumference of the filter drum, normally less than about 180° . Despite the fact that this type of device has been known for decades and that longer effective dewatering zones have been known for a considerable number of years for devices with only one filter drum, nobody has been able to realize a working concept which incorporates a long effective dewatering zone for equipment with two filter drums.

A second problem is how to clean the filter drums continuously during operation. For this purpose sprays have been used which use water jets to remove remaining fibre residues. In certain cases it is desired also that the holes in the filter drum are cleaned of deposits. This calls for high pressure nozzles to be used working at pressures over 200 bar and as high as 2000 bar. Thus, in U.S. Pat. No. 5,421,176 and in devices with two filter drums (for example U.S. Pat. No. 4,861,433) sprays are arranged on the filter drum's descending side. This enables the flushed-off fibres to fall off and ensures that the dewatered pulp is not wetted by the water from the sprays. Another alternative for cleaning sprays is disclosed in U.S. Pat. No. 5,667,642 where the sprays are arranged below the filter drum. Here the flushed-off fibres can fall off and away from the filter drum.

A related problem is to achieve a trough construction which encloses a large section of the filter drum, circumference and which is still easy to displace in relation to the filter drums for cleaning and washing of the filter drums and the space between the trough and the filter drums.

One objective of the invention described here is to offer an improved dewatering capacity. This is achieved by means of double filter drums with a fibrous web round at least 230° , and by completing the fibrous web or webs with a pres pinch in which evacuation of fluid takes place in the pinch in both directions in the filter drums' interior.

A further objective is to provide additional washing zones in a dewatering device.

Another objective is to construct a more effective device for the washing and/or dewatering of a fibrous suspension which provides increased capacity or alternatively a smaller device with the same capacity when compared with the larger plant based on known technology.

Another objective is to obtain a device for washing and/or dewatering where a very high degree of initial dewatering can be obtained.

Another objective is to be able to clean the filter drum part continuously during operation without wetting the dewatered pulp and so that the flushed-off fibres can be channelled away.

According to one aspect of the invention the trough is installed to enclose the outer surface of the filter drum from the inflow chamber and further round at least 230° , preferably at least 245° and most preferably at least 260° of the circumference of the outer surface, so that during operation the fibrous web is constrained to run between the outer surface of the filter drum and the trough at least 230° , preferably at least 245° and most preferably at least 260° of the circumference of the outer surface before the fibrous web reaches the press pinch.

According to another aspect of the invention the pulp inflow chamber is installed at −20° and 40° , preferably at −10° and 30° , more preferably at 0° and 30° or most preferably at 0° and 20° round the filter drum, where 0° denotes the filter drum's highest point and a positive increase in degrees is reckoned in the direction of rotation of the filter drum. The pulp inflow chamber itself can be installed somewhat after the highest point of the filter drum but have a distribution chamber where distribution of the pulp fed out occurs to a certain extent contrary to the direction of rotation of the filter drum and towards its highest point.

According to a further aspect of the invention the trough contains an upper trough segment which encloses the outer surface of the filter drum from the pulp inflow chamber to an end point which is located approximately 90° to 130° , preferably 110° to 120° from the pulp inflow chamber, reckoned in the direction of rotation of the filter drum. Further, the upper trough segment is suitably pivotable about an axle 9, which is parallel to the outer surface of the filter drum and is installed close to the said end point 11, preferably at a maximum of 30° from the said end point. Thus the pivoting can take place at a distance from the pulp web as shown in the FIG. and in certain cases displaced relative to the angular extent of the filter drum. The trough also includes a lower trough segment which encloses the outer surface of the filter drum from the upper trough segment's end point trough to the pinch and which trough segment can be lowered.

According to another aspect of the invention the device can either include two stationary pulp inflow chambers, one for each filter drum, whereby the device is in the main symmetrical in a symmetry plan which is based on a tangent to the filter drum in the pinch, or can consist of a principal filter drum equipped with a pulp inflow chamber and converging trough, while the second filter drum provides a perforated press roller with internal evacuation chambers for increased dewatering in the pinch, and where the said second filter drum preferably has a smaller diameter than the first filter drum.

BRIEF DESCRIPTION OF THE FIGURES

In the following, the invention is described with reference to FIGURES where.

DETAILED DESCRIPTION

Figure 1:
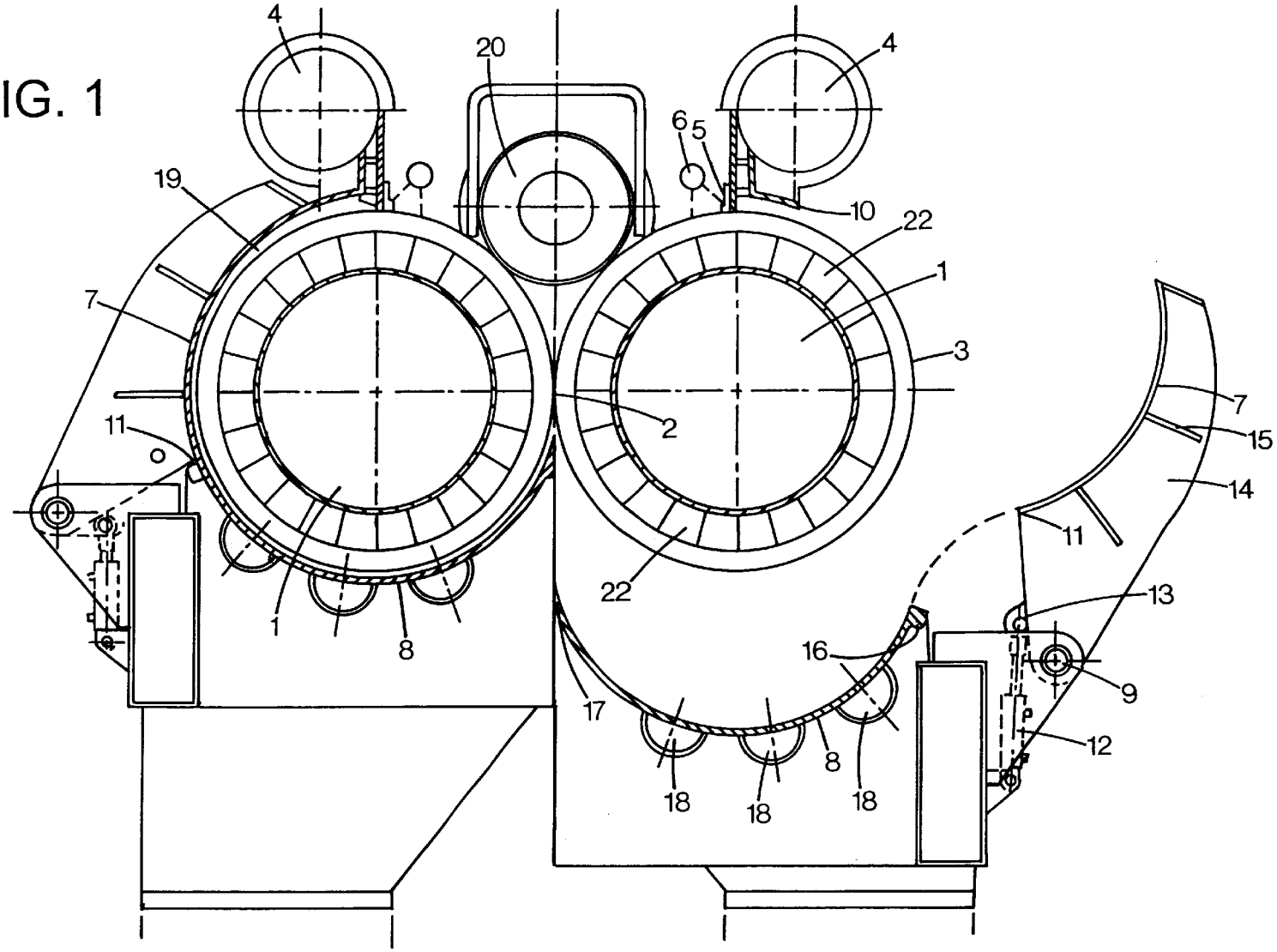
FIG. 1. shows a preferred embodiment of the device according to the invention, viewed in cross section, FIG. 2. shows another embodiment according to the invention, viewed in cross section.

The preferred embodiment of the device according to the invention is shown in FIG. 1 and includes two hollow, circular cylindrical filter drums 1, which incorporate a number of evacuation chambers under the outer surface of the filter drums to lead the evacuated fluid away. Preferably there is a pressure difference between the outside of the outer surface of the filter drums and these inner evacuation chambers, which is best achieved by introducing the pulp under external pressure. The two filter drums form a pressure pinch 2 between each other and are designed to rotate in opposite directions so that, seen from the end face, the filter drum on the right rotates clockwise and that on the left rotates anticlockwise. The spacing between the filter drums which forms the pinch 2 can preferably be adjusted by adjusting means for the mutual location of the filter drums (not shown). As the equipment is in the main symmetrical in a symmetry plane which is based on a tangent to the filter drums 1 in the pinch 2, only one symmetry section is in principle depicted.

The filter drum 1 has optimally a diameter of from 1.0–2.5 metres. Further, its outer surface 3 is perforated with holes or slits to enable the fluid to be evacuated from a fibrous web lying against the outer surface and further into the evacuation chambers inside the filter drum. The fluid is then led away from the device in the direction of the length of the filter drum via a fluid discharge pipe (not shown). The outer surface of the filter drum can also be covered, if appropriate, with a filter cloth. Preferably, the filter drum is divided on the inside round its circumference into individual evacuation chambers 22 which lead the evacuated fluid away axially within the filter drum in divided part flows in a manner known per se. The removed wash fluid or drained fluid is led via these evacuation chambers longitudinally out towards the end plates of the filter drum. The evacuation chambers 22 communicate with each other via channels being formed round the circumference between the supports (not shown) installed directly under the filter plates bearing against the axially directed evacuation chambers.

In the preferred embodiment shown in FIG. 1 a pulp inflow chamber 4 is provided for each filter drum 1. Each pulp inflow chamber 4 is installed at 0° to the filter drum where 0° corresponds to the filter drum's highest/uppermost point and a positive increase in degrees is reckoned in the direction of rotation of the filter drum. The incoming pulp, which normally has a concentration in the range of from 1–12%, evenly 3–10%, is over distributed by means of the inflow chamber over the filter drum's entire length. On the inflow chamber's back wall a longitudinal seal 5 is installed. This bears against the filter drum's outer surface 3 and prevents fluid from running from the incoming pulp suspension in the direction of rotation and down into the already dewatered pulp. A spray 6 is installed to flush away fibres which may collect on the seal 5 and to clean the holes or slits in the filter drum's outer surface 3. The seal 5 is suitably constructed so that a part of the fibre which may be left behind on the filter drum is allowed to pass under the seal, but nevertheless maintaining a good seal against the pulp in the inflow chamber 4.

In the preferred embodiment shown in FIG. 1 there is further installed a trough which for each filter drum 1 consists of at the least two parts, an upper trough segment 7 and a lower trough segment 8. The upper segment 7 encloses the filter drum's outer surface from the mass inflow chamber 4, where the upper trough segment in the operating position is essentially sealing the device against the pulp inflow chamber, or as shown against a short distance of the uppermost segment 10 which is built as part of the pulp inflow chamber. The upper trough segment has in the preferred embodiment a lower end point 11 at about 115° (in the operating position) and is pivotable about an axle 9, which axle is parallel to the filter drum's outer surface 3 and is installed close to the said end point 11. Axle 9 is suitably installed a short radial distance outside the filter drum, preferably at the same angular position as end point 11. When the upper trough segment is to be pivoted, for example to enable cleaning of the filter drum, a hydraulic cylinder 12 pulls the trough segment down via a lever between axle 9 and the hydraulic cylinder's connecting point 13 in the upper trough segment. The upper trough segment is reinforced with a number of external ribs 14, which number is appropriate to the width of the trough, which extends along the upper trough segment's 7 circular section and which is provided with additional reinforcing, transverse struts 15.

Since the upper trough segment 7 is pivotable at its lower part there is the advantage that forces in the securing parts can be conveyed to the bottom support when opening the trough segment. Preferably there is also a locking effect by the trough segment's outer end against the inflow chamber when the trough segment takes up its final position, whereby a certain fraction of the forces arising from dewatering power are directed also to the inflow chamber section.

In the operating position the upper trough segment end point 11 forms a seal with the lower trough segment 8. The lower trough segment 8 is equipped at this end with a longitudinal reinforcement 16 against which the upper trough segment can best bear. The lower trough section 8 then extends from the upper trough segment's end point, along the outer surface 3, to the pinch 2. It is clear that the end of the lower trough segment 8 cannot reach into the pinch, and is best terminated at the point where the distance between the two filter drums 1 corresponds approximately to twice the gap width at the lower trough segment's end point. Also at this end point the lower trough segment is equipped with a longitudinal reinforcement 17. A number of washing zones 18, incorporating inlets, not shown, for the washing fluid, are arranged on the lower trough segment 8. In the embodiment shown three longitudinal washing zones have been installed at about 140°, 170° and 200° respectively. The lower trough segment 8 can be lowered for access to and cleaning of the filter drum's outer surface 3. Lowering of the lower trough segment 8 is carried out with a suitable device, preferably an hydraulic adjusting device.

Between the outer surface 3 of the filter drums and the trough 7,8 there is a gap 19, which gap is arranged to narrow from the pulp inflow chamber 4 to the pinch 2, although here and there widening sectors can occur, for example in the washing zones 18 where washing fluid is to be introduced on to the fibrous web present in the gap. The width of the gap between the walls of the trough and outer surface 3 is adjustable so that optimal dewatering is achieved and can be set depending on the concentration of the incoming fibrous web and the desired degree of dewatering. The width of the gap at the inflow is typically of the order of 50–150 millimetres whilst the gap width at the outflow is typically of the order of 10–40 millimetres. The trough 7,8 is preferably arranged to allow a slight overpressure up to 0.5 bar (gauge), which overpressure can be adjusted to ensure a desired pressure difference over the filter drum's outer surface. It can be that up to and including all the pressure difference is accomplished by means of an underpressure in the filter drum only, or a combination of underpressure in the filter drum and an overpressure in the trough. The trough is also sealed (not shown) from the external surroundings at the end plates of the filter drums.

Above the pinch 2, a doctor blade and conveyer screw 20 is installed, which tears off the washed and dewatered fibrous web and conveys it for further treatment for paper pulp production. Alternatively or complimentarily, a plough share can be used to release the fibrous web from the outer surface 3.

In operation a pulp with a concentration of about 1–12% is introduced into the gap 19 via the inflow chamber 4. The filter drums 1 are designed to rotate with a speed of 5–20 rpm by means of an appropriate drive system. The pulp consequently follows the filter drums's rotation in the gap 19 between the perforated outer surface 3 and the walls of the trough 7,8, whereby a fibrous web is formed which is dewatered due to the converging of the gap in the direction of the pinch. The fluid which is pressed out of the fibrous web is led away (not shown) from the device. In the washing zones 18, where the gap can widen slightly, washing fluid is introduced on to the fibrous web, whereby washing of the same takes place. The fibrous web is finally dewatered by the pressure in pinch 2 to a concentration which is about 5–20 times higher than that of the incoming pulp, for example 1–12% at the inflow and 25–40% after the pinch. The fibrous web is separated from the outer surface 3 and is led away from the equipment by means of the doctor blade and conveyer screw 20.

Figure 2:
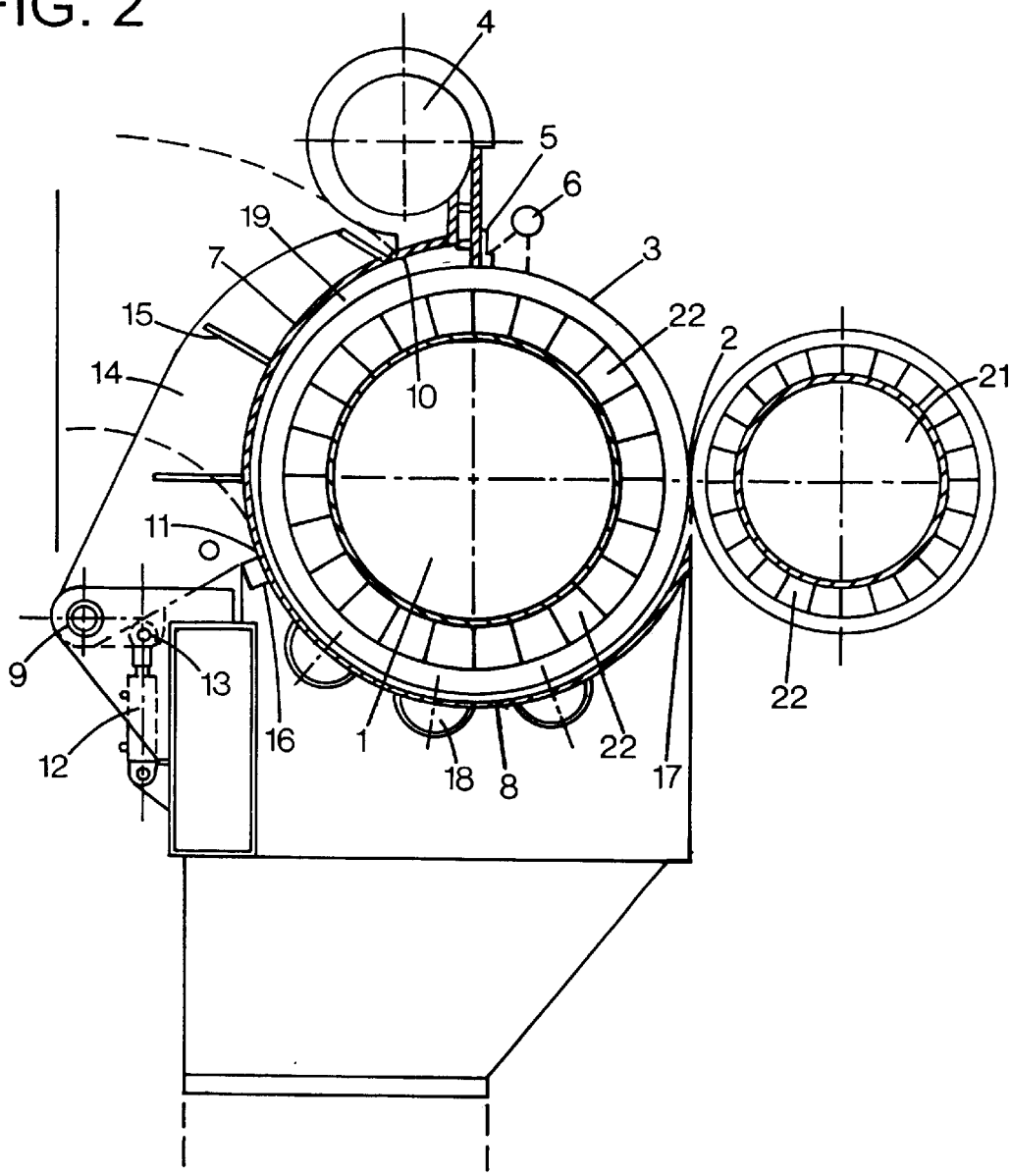

A second embodiment of the invention is shown in FIG. 2 where the principle differs from that in FIG. 1 in that only the one filter drum 1 is equipped with a pulp inflow chamber 4 and trough 7,8. The other filter drum 21 constitutes in principle an actuating press roller in the pinch 2, whereby according to the embodiment a particularly effective dewatering is obtained in the pinch 2 due to the pinch consisting of two filter drums, compared with conventionally in a single press, only one filter drum and a press roller with an unperforated outer surface. It is also possible, in principle, to envisage the trough in this embodiment further extended, whereby the inflow is displaced towards the press pinch, for example from 0° to 45°. The filter drum 21 also has a surrounding housing (not shown). The dewatered pulp is conveyed after the pinch in the same manner as in FIG. 1. In both the embodiments shown, the pulp inflow chamber is installed at the filter drums' highest point. This implies that the pulp in the inflow chamber initially places an hydrostatic pressure on to the filter drums' outer surface, which gives an improved initial dewatering.

The equipment according to the invention is not limited to the embodiments described above, but can be varied within the scope of the following patent claims. Thus, for example, it is obvious for a person skilled in the art that arrangements for pivoting of the upper trough segment or the lowering of the lower trough segment can be achieved in a countless number of ways, for which this merely requires adjustments by a person skilled in the art.

The circular cylindrical filter drums can also be arranged so that their axes of rotation do not lie in the same horizontal plane, but instead in horizontal planes which are somewhat displaced relative to each other. It is essential though that the high pressure nozzles 6 must be allowed to act against an essentially upwardly directed outer surface of the filter drum, the perforations of which outer surface being capable of evacuating the fluid which the high pressure nozzles spray against the outer surface. This is a matter of adjustment where the amount of fluid which the high pressure nozzles deliver must be weighed against the permeability of the outer surface.

What is claimed is:

1. A device for washing and dewatering a fibrous suspension, comprising:

a first circular cylindrical filter drum arranged to rotate in a first direction, the first filter drum being hollow and permits an evacuation of a fluid in a radial inward direction into the first filter drum, the first filter drum having a first outer surface and a first evacuation chamber defined therein, the first filter drum having an axis of rotation in a horizontal plane, the first filter drum having a highest point;

a second circular cylindrical filter drum arranged to rotate in a second direction, the second direction being opposite the first direction, the second filter drum bearing against the first filter drum so that a nip is being created therebetween, the second filter drum being hollow and having a second evacuation chamber defined therein, the second filter drum having an axis of rotation in a horizontal plane being substantially the same as the horizontal plane of the first filter drum;

the first filter drum being disposed inside a first trough segment and a second trough segment, the first and second trough segments partly enclosing the first outer surface, the first and second trough segments converging towards the first outer surface in the first direction; and a first pulp inflow member being in fluid communication with a channel defined between the first outer surface and the first and Second trough segments for the introduction of pulp into the channel to form a fibrous web therein, the first pulp inflow member being disposed above the nip, the first and second trough segments enclosing the first outer surface extending from the first pulp inflow member and further around to at least 230° of a circumference of the first outer surface so that the fibrous web in the channel is being confined to flow in the channel at least 230° of the circumference of the first outer surface before the fibrous web reaching the nip to form a long dewatering zone on the first filter drum followed by a double sided dewatering at the nip.

2. The device according to claim 1 wherein the first and second trough segments enclose at least 245° of the circumference of the first outer surface so that the fibrous web in the channel is confined to flow in the channel at least 245° of the circumference of the first outer surface before the fibrous web reaches the nip.

3. The device according to claim 1 wherein the first and second trough segments enclose at least 260° of the circumference of the first outer surface so that the fibrous web in the channel is confined to flow in the channel at least 260° of the circumference of the first outer surface before the fibrous web reaches the nip.

4. The device according to claim 1 wherein the first pulp inflow member is installed in an interval ranging from −20° to +40° of the circumference of the first outer surface when 0° denotes the highest point of the first filter drum and the degrees increase in the first direction.

5. The device according to claim 4 wherein the interval ranges from −10° to +30°.

6. The device according to claim 4 wherein the interval ranges from 0° to +30°.

7. The device according to claim 4 wherein the interval ranges from 0° to +20°.

8. The device according to claim 1 wherein the device has a washing zone that is positioned at least 90° along the circumference of the first outer surface of the first filter drum downstream of the first pulp inflow member in the first direction.

9. The device according to claim 8 wherein the washing zone is positioned between about 120° and 230° along the circumference of the first outer surface of the first filter drum downstream of the first pulp inflow member in the first direction.

10. The device according to claim 8 wherein the washing zone is positioned between about 20° and 90° along the circumference of the first outer surface of the first filter drum downstream of the first pulp inflow member in the first direction.

11. The device according to claim 8 wherein the washing zone is positioned between about 30° and 80° along the circumference of the first outer surface of the first filter drum downstream of the first pulp inflow member in the first direction.

12. The device according to claim 1 wherein the first trough segment has an upper trough part that encloses a first portion of the first outer surface of the first filter drum, the upper trough part extends from the first pulp inflow member to an end point that is located about 90° and 130° along the circumference of the first outer surface of the first filter drum downstream of the first pulp inflow member in the first direction.

13. The device according to claim 12 wherein the end point is located about 110° and 120° along the circumference of the first outer surface of the first filter drum from the first pulp inflow member in the first direction.

14. The device according to claim 12 wherein the upper trough part is pivotable about an axle that is parallel with the first outer surface of the first filter drum and is positioned adjacent to an end point of the first trough segment.

15. The device according to claim 14 wherein the upper trough part is not more than 30° from the end point.

16. The device according to claim 14 wherein the first trough segment has a lower trough part that encloses a second portion of the first outer surface of the first filter drum from the end point through to the nip.

17. The device according to claim 16 wherein the lower trough pare is openable.

18. The device according to claim 16 wherein the lower trough part is lowerable.

19. The device according to claim 1 wherein the device has a cleaning spray nozzle arranged between the nip and the first pulp inflow member, the cleaning spray nozzle is directed towards the first outer surface of the first filter drum.

20. The device according to claim 1 wherein the device has a second pulp inflow member for the second filter drum so that the second pulp inflow member and the second filter drum are symmetrically positioned relative to the first pulp inflow member and the first filter drum.

21. The device according to claim 1 wherein the second filter drum has a perforated press roller having internal evacuation chambers defined therein for increased dewatering at the nip.

22. The device according to claim 1 wherein the first filter drum has a first diameter that is greater than a second diameter of the second filter drum.

* * * * *